United States Patent [19]

Klötzner et al.

[11] 4,143,622

[45] Mar. 13, 1979

[54] FUEL INJECTION APPARATUS FOR INTERNAL COMBUSTION ENGINES

[75] Inventors: Winfried Klötzner, Schwieberdingen; Rolf Däumer, Merklingen; Wolfgang Busse, Hildesheim; Hans-Christoph du Mont, Renningen, all of Fed. Rep. of Germany

[73] Assignee: Robert Bosch GmbH, Stuttgart, Fed. Rep. of Germany

[21] Appl. No.: 742,720

[22] Filed: Nov. 17, 1976

[30] Foreign Application Priority Data

Nov. 18, 1975 [DE] Fed. Rep. of Germany ..... 2551688

[51] Int. Cl.[2] ..... F02B 3/02

[52] U.S. Cl. ..... 123/32 EC

[58] Field of Search ..... 123/32 EC, 32 EB, 32 EA, 123/139 AM, 139 E

[56] References Cited

U.S. PATENT DOCUMENTS

| | | | |
|---|---|---|---|
| 3,835,821 | 9/1974 | Hill et al. | 123/32 EB |
| 3,911,872 | 10/1975 | Hughes | 123/119 E |
| 3,964,443 | 6/1976 | Hartford | 123/32 EB |
| 3,982,503 | 9/1976 | Keranen | 123/32 EA |

*Primary Examiner*—Samuel Feinberg

*Attorney, Agent, or Firm*—Edwin E. Greigg

[57] ABSTRACT

A fuel injection apparatus for internal combustion engines, having a digital control apparatus for producing an actuating electrical signal for the engine injection valves proportional to the engine speed and the quantity of air aspirated by the engine, and a signal correction apparatus for modulating the injection actuating pulse in accordance with other parameters of the engine, such as fuel enrichment during starting or warmup of the engine, adjustment for idle, partial load, and full load conditions, and adjustment for the air-fuel ratio for both short time variable conditions, and long time variations such as variations in barometric pressure. This correction apparatus includes auxiliary storage register, interconnected to numerical frequency converters, which produce the correction signal from the information stored in the auxiliary storage registers.

22 Claims, 4 Drawing Figures

FUEL INJECTION APPARATUS FOR INTERNAL COMBUSTION ENGINES

CROSS REFERENCE TO RELATED APPLICATIONS

U.S. Application of Rolf Daumer et al, Ser. No. 742,715, filed Nov. 17, 1976.

BACKGROUND OF THE INVENTION

The invention relates to a fuel injection apparatus for internal combustion engines. The apparatus includes a control apparatus which produces an uncorrected injection pulse, in accordance, for example, with the aspirated air quantity per stroke, for the controlling of at least one injection valve of the engine. The apparatus also includes a correction frequency generator, for modulating the injection pulse for the injection valve, in accordance with the various operational parameters of the combustion engine.

Digital control apparatuses for fuel injection systems are capable of computing the injection time during which fuel is supplied to the cylinders of the internal combustion engine via electromagnetic injection valves, that is of computing the duration of the electrical pulses delivered to the injection vlaves. The duration is computed from the basic data regarding the air quantity aspirated by the internal combustion engine, and from crankshaft rpm. A so-called uncorrected injection pulse is formed from these basic data. This uncorrected injection pulse is still dependent upon further operational parameters of the internal combustion engine, for example, temperature. It is, moreover, still not attuned to the various conditions present, for example, during idling, partial load operation, and full load operation. This attuning to the cited and to other operational parameters is accomplished with a correction apparatus, which adjusts, to a geeater or lesser extent, the uncorrected injection pulse in accordance with the given operational parameters. The corrected injection pulse is commonly still further processed by a correcting circuit for a battery voltage dependent compensation of the injection pulses. Subsequent thereto, the injection pulses are delivered in their final form to the injection valves of the internal combustion engine via the distribution and amplifier stages, where they determine the injection time, i.e., the fuel quantity to be injected per stroke.

OBJECT AND SUMMARY OF THE INVENTION

It is a principal object of the invention to provide a correction apparatus which generates a correction frequency signal for the correction of the uncorrected injection pulse from a multiplicity of data present in digital form, wherein the formation of the correction frequency signal shall proceed rapidly, and wherein the expenditure for the circuitry required shall be kept exceedingly low.

This object is achieved, according to the invention, by the fact that the correction apparatus possesses auxiliary storage registers for the reception, from a main storage register, of information present in digital form, and the fact that the auxiliary storage registers are interconnected to numerical frequency converters, which produce the correction signal at the correction frequency from the information stored in the auxiliary storage registers.

Further advantageous configurations and appropriate refinements of the invention will become evident, in conjunction with the claims, from the following description of an examplary embodiment, and from the associated drawings.

DETAILED DESCRIPTION OF A PREFERRED EMBODIMENT

Figure 1:
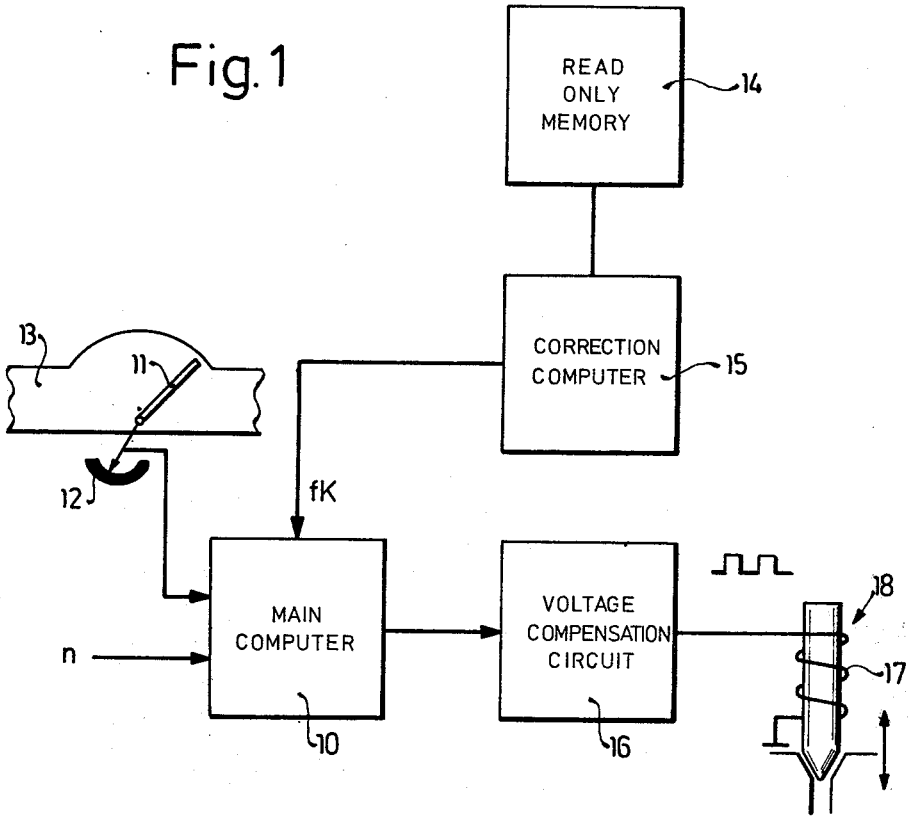
FIG. 1 is a fundamental block diagram of a fuel injection apparatus.

FIG. 1 depicts a digital control apparatus 10 for a fuel injection apparatus. The digital control apparatus is commonly called the main computer. This main computer 10 produces an uncorrected injection pulse from, for example, a signal corresponding to the given revolutions per unit time and from an air quantity signal that is proportional to the air quantity aspirated by the internal combustion engine. The air quantity signal is commonly formed with the aid of a barrier flap 11 and a potentiometer 12, wherein the barrier flap is disposed within an intake suction tube 13 of the combustion engine, and is deflected more or less energetically in correspondence to the given aspirated air quantity, the barrier flap in turn displacing the wiper of the potentiometer 12. The signal extractable at the wiper of the potentiometer 12 is thus proportional to the given aspirated air quantity.

The present fuel injection apparatus also possesses a fixed value storage register 14 commonly designated as a ROM (read only memory), which stores, in digital form, various operational parameters of the combustion engine. From the multiplicity of the stored operational parameters in the ROM 14, a correction apparatus 15, commonly called a correction computer, forms a correction frequency fK, which is brought to the main computer 10, and which corrects the uncorrected injection pulse in accordance with the data magnitudes stored in the ROM 14. The corrected output signal of the main computer 10 is further conducted to a circuit 16 for the corrective compensation of the injection pulse in accordance with the given battery voltage in the electrical wiring system of the motor vehicle. The injection pulse is next applied to the working winding 17 of a schematically represented injection valve 18, which determines the fuel quantity delivered to the combustion engine by opening for the given duration of the injection pulse.

Figure 2:
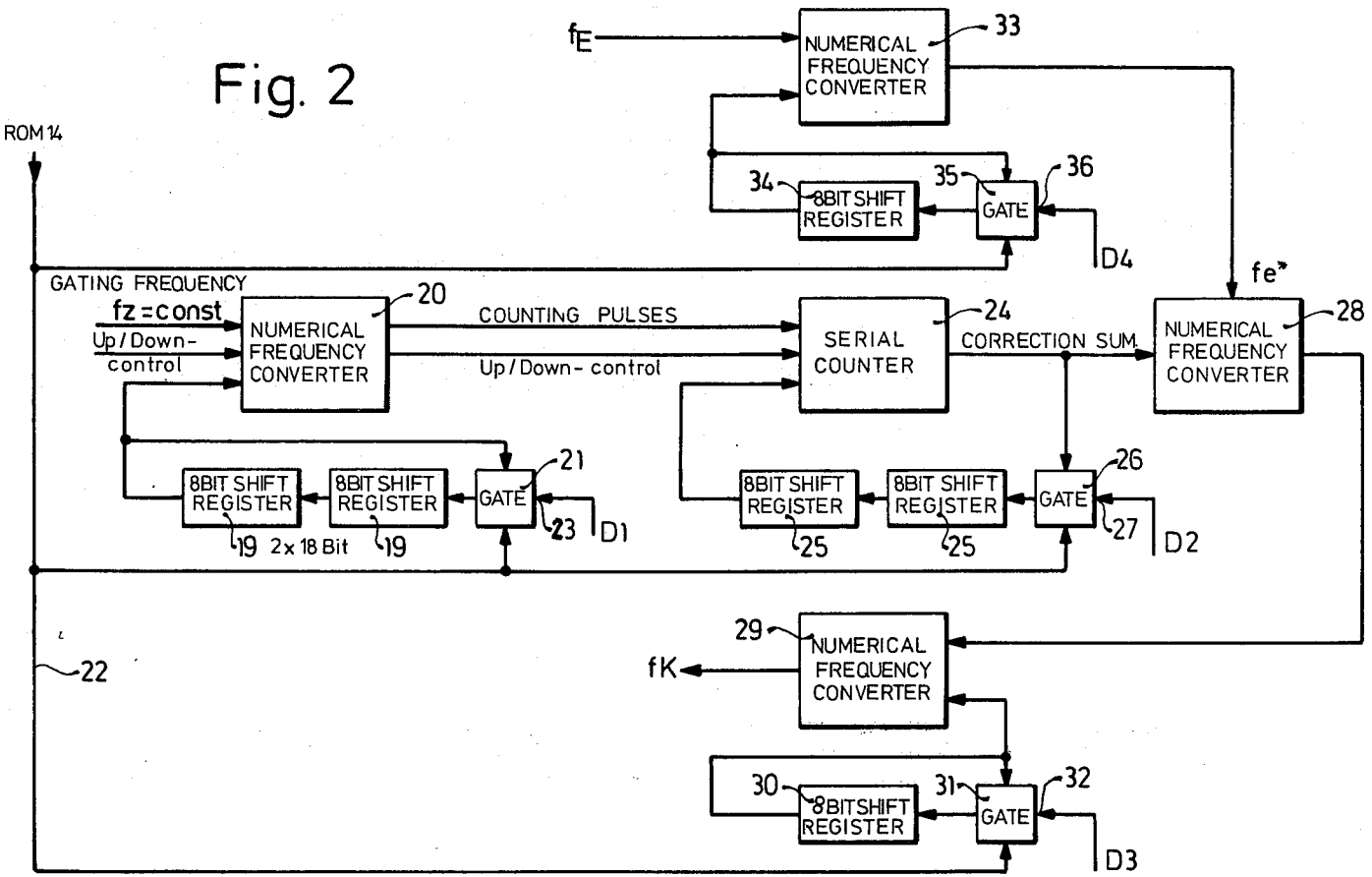
FIG. 2 is a block circuit diagram of the correction apparatus of FIG. 1.

FIG. 2 represents the correction computer 15 in a block diagram. The correction computer 15 includes a first auxiliary storage register 19, which can consist, for example, of a 2 by 8 bit shift register. This auxiliary storage register is connected to a first numerical frequency converter 20, which receives a constant frequency $fZ$. Directly preceding the first auxiliary storage register 19 is a switching logic circuit 21, which can connect the first auxiliary storage register with a data bus line 22, via which digital information can be transferred by a multiplexing operation from the ROM 14 depicted in FIG. 1, to the first auxiliary storage register 19. The first switching logic circuit 21 must be controlled by a multiplex rate pulse via a control input 23.

Information in digital form, concerning the mutually independent regulation times of a starting enrichment and of a post starting enrichment of the fuel-air mixture delivered to the combustion engine, can be stored in the first auxiliary storage register 19. Both kinds of information can be required at the same time. By means of the dual multiplexing operation of the numerical frequency converter 20, as well as of a counter 24 interconnected downstream, it is possible to have both regulation processes progress independent of one another. Alternatively, information about the regulation of the air number λ of the fuel-air mixture delivered to the combustion engine can additionally be stored in the first auxiliary storage register 19. The first numerical frequency converter 20 now forms a counting frequency *f*ZF1 for the starting enrichment and the post starting enrichment regulation, wherein the counting frequency *f*ZF1 is conducted to a serial counter 24. The first numerical frequency converter 20 is additionally connected with the serial counter 24 via a sign digit control line; this sign digit control line is, however, only required in conjunction with the still to be described regulation process of the air number λ.

A second auxiliary storage register 25 which can, for example, also be constructed as a 2 by 8 shift register, is assigned to the serial counter 24. Information about a temperature dependent initial magnitude of the starting enrichment and of the post starting enrichment of the fuel-air mixture for the combustion engine is stored in this second auxiliary storage register 25. To facilitate the transfer of digital information stored in the ROM 14, the second auxiliary storage register is connected to a second switching logic circuit 26, which likewise connects the second auxiliary storage register 25 in a multiplex operation with a data bus line 22, wherein a multiplex pulse is applied to the control input 27 of the second switching logic circuit 26. The serial counter 24 produces a time dependent number, which appears at its output, and which is conducted to a second numerical frequency converter 28. This second numerical frequency converter 28 is connected with a third numerical frequency converter 29 having a third auxiliary storage register 30, which can, for example, be constructed as an 8 bit shift register; information regarding a starting enrichment or a warm running enrichment of the fuel-air mixture for the combustion engine can be stored in this third auxiliary storage register. These two magnitudes are alternatively storable, since they are not needed simultaneously. To accomplish the storage of the information in the third auxiliary storage register, a third gating circuit 31 is provided, which connects the third auxiliary storage register 30, in a multiplex operation, with the ROM 14 via the data bus line 22, so that the given requisite data can be received at a control input 32 of the third switching logic circuit 31, controlled by a multiplexing pulse rate. The third numerical frequency converter 29 thus forms a variable output frequency *f*K from the input frequency as a function of the storage register content of the third auxiliary storage register 30, which output frequency *f*K constitutes the correction frequency, and which is conducted to the main computer 10, according to FIG. 1.

The input frequency signal of the second numerical frequency converter 28 is supplied by a fourth numerical frequency converter 33, to which a fourth auxiliary storage register 34 is assigned, which can likewise be constructed as an 8 bit shift register. Data pertaining to an idle running apportionment, a partial load apportionment, and a full load apportionment of the fuel-air mixture delivered to the combustion engine can be stored in this fourth auxiliary storage register. The fourth auxiliary storage register 34 is connectable with the data bus line 22, and thereby with the ROM 14, via a fourth gating circuit 35, for the reception of data, wherein a multiplexing pulse rate can be applied at a control input 36 of the fourth switching logic circuit 35. Thus information respectively concerning the idle running apportionment, the partial load apportionment, and the full load apportionment is alternatively stored in the fourth auxiliary storage register 34, since these various data are not needed simultaneously. The numerical frequency converter 33 thus forms an output frequency from a constant input frequency *f*E, in accordance with the information stored in the fourth auxiliary storage register 34, which output frequency is transmutable by the information just stored in the fourth auxiliary storage register 34.

The input frequency *f*E, which is constant in this exemplary embodiment, can also be switchable to other frequencies, and can thereby produce a favorable interaction possibility for a further consideration of other correction quantities.

The numerical frequency converters 28, 29, 33 differ from the numerical frequency converter 20 in that they are only equipped with an 8 bit shift register, and that they do not possess any sign digit control.

In the exemplary embodiment according to FIG. 2, four numerical frequency converters are provided, whose auxiliary storage registers are controlled, and supplied with data, in a multiplex operation. In the depicted exemplary embodiment, according to FIG. 2, a dual multiplex operation of the first numerical frequency converter 20, as well as of the serial counter 24, is therein additionally provided. One thus acquires the possible option that two counting processes that are chronologically independent of one another can proceed in both of the switching circuits. This fact can be advantageously exploited for the chronological regulation of a post starting enrichment as well as of a starting enrichment, or alternatively for a λ regulation apparatus having a short and a long integration time. However, it is possible without difficulty, and it is viewed as lying within the framework of the present invention, that the number of numerical frequency converters be reduced and that the multiplexing frequency be correspondingly increased, so that the then remaining numerical frequency converters and the associated auxiliary storage registers are utilized more frequently at a higher multiplexing rate.

In regard to the method of operation of the exemplary embodiment according to FIG. 2, the following is, in particular, still to be mentioned: The first numerical frequency converter 20 delivers, as was already further indicated above, counting frequencies for the regulation of the post starting enrichment and the starting enrichment, as well as the counting frequency and the FORWARD-BACKWARD control of the serial counter 24 in the regulation of the aix number λ of the fuel-air mixture delivered to the combustion engine. The serial counter 24, interconnected at the output of the first numerical frequency converter 20, undertakes the chronological regulation of the post starting enrichment and the starting enrichment, and in its stationary condition, that is to say whenever no correction factors relating to a regulation of a starting enrichment and a post starting enrichment are present, the serial counter 24 acts as a regulator for the regulation of the air number λ, because the serial counter 24 can then be conveniently employed as a regulator possessing an integration behavior. The expenditure for the correction computer 15 is therewith decreased noticeably, because the λ regulation is, in any case, only effective whenever no corrections concerning the post starting enrichment and the starting enrichment are needed. In addition, the possibility exists that large and small integration time constants for the regulation apparatus for the regulation of the air number λ can be obtained, wherein these data are storable in the first auxiliary storage register 19. The regulation apparatus can then be utilized in conjunction with the large time constant for the regulation of the long term drift of the outer components, for example, of the injection valves, or else it can undertake a correction of the fuel-air mixture in accordance with the given barometric magnitude. The regulation apparatus is operated, on the other hand, with the small time constant whenever the customary disturbances in the composition of the fuel-air mixture are to be eliminated by means of the regulation.

A time dependent number is available at the output of the serial counter 24. The second numerical frequency converter 28 interconnected at the output of the serial counter 24 thus now adds the correction factors supplied by the serial counter 24 and converts the sum into a signal of proportional frequency. The input frequency of the second numerical frequency converter 28 is also already conditioned by the information concerning the idle apportionment of the fuel-air mixture; this information is processed in the fourth numerical frequency converter 33 under the influence of the constant input frequency $f$E, which, in addition, can be switchably alterable. The output frequency of the second numerical frequency converter 28 is conducted to the third numerical frequency converter 29, which then in turn varies the input frequency in accordance with the information stored in the third auxiliary storage register concerning a starting enrichment or a warm running enrichment of the fuel-air mixture, and which therewith forms the correction frequency $f$K. The correction frequency $f$K represents the product of temperature dependent factors, temperature dependent and time dependent factors, as well as apportionment factors for the post starting enrichment, the starting enrichment, the idle running apportionment, the full load apportionment, the partial load apportionment, and for the air number λ regulation.

The selection of the alternative data, for example that concerning either a starting enrichment or a warm running enrichment, and either an idle running apportionment or a partial load apportionment or a full load apportionment, takes place during the storing of the auxiliary storage registers by means of an address control apparatus, which, in turn, is influenceable by means of switching positions, for example of an idle running switch or of a full load switch, or by means of programmable temperature thresholds or equivalent data.

Figure 3:
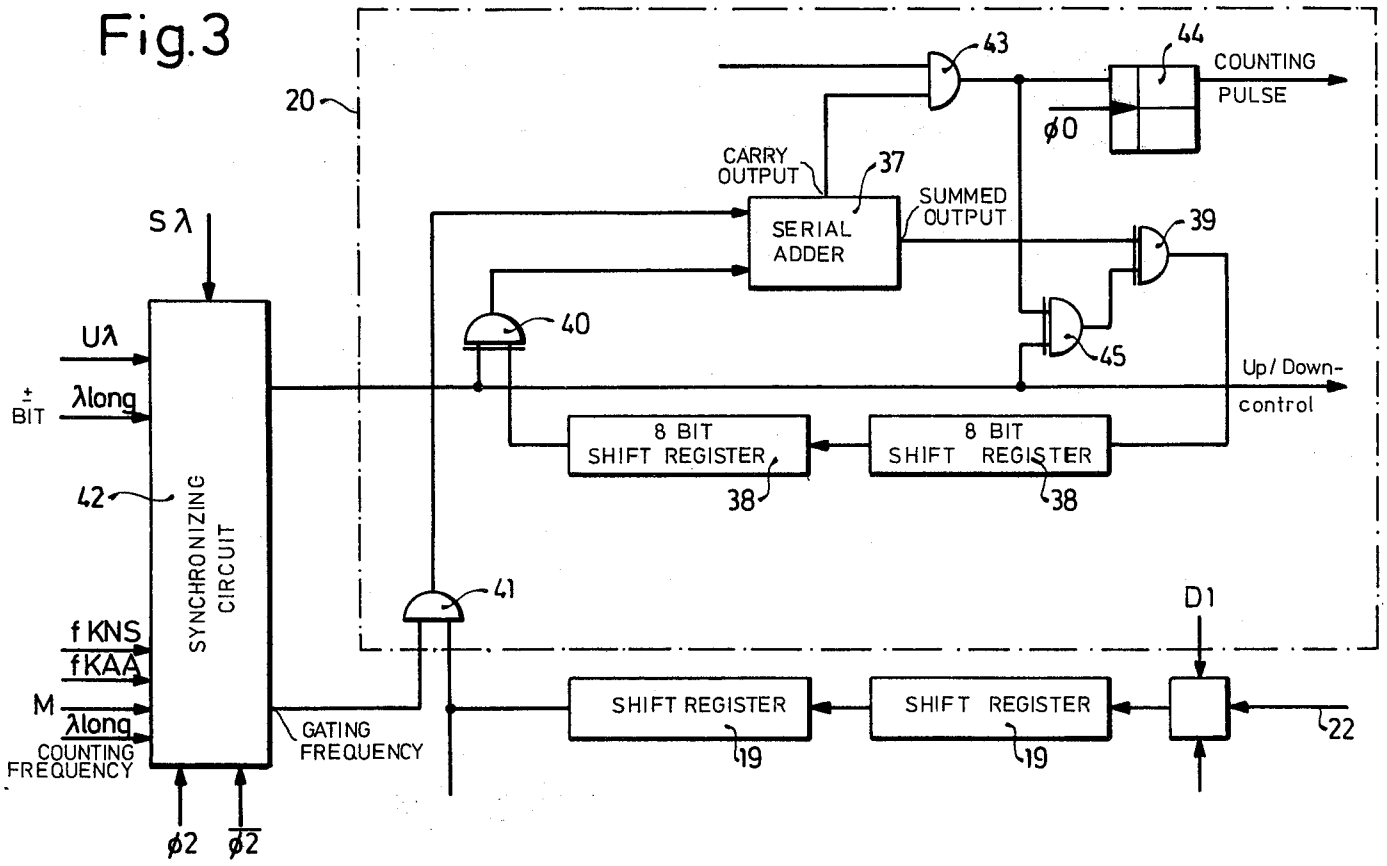
FIG. 3 is a detailed block circuit diagram of a numerical frequency converter of FIG. 2.

FIG. 3 is a detailed representation of the first numerical frequency converter 20. A principle component of this first numerical frequency converter 20 is the serial adder 37, and a shift register 38 connected in parallel with the serial adder 37, which shift register 38 can, for example, be constructed as a 2 by 8 bit shift register. The output of the serial adder 37 is connected to the input of the shift register 38 via an EXCLUSIVE OR gate 39, and the output of the shift register 38 is connected to the first input of the serial adder 37 via an EXCLUSIVE OR gate 40. An AND gate 41 precedes the second input of the serial adder 37, the first input of the AND gate 41 is connected to the first auxiliary storage register 19 depicted in FIG. 2, and the second input of the AND gate 41 is connected to a synchronizing apparatus 42.

The method of operation of this principal component of the numerical frequency converter 20 shall be elucidated in the following: The shift register 38 encompasses a given desired number of storage locations; in the shift register 38 of the present case 2 by 8 bits are provided. The number of storage locations determines the maximal word length which the shift register 38 can accommodate. Since this circuit works in a dual multiplex operation, two mutually independent numbers, each having a maximal word length of 8 bits, result herefrom. The storage locations of the shift register receive a shift pulse signal, and the register content of the shift register 38 is shifted along by one position with each such shift pulse, so that, at any given time, the word contained in the shift register reaches the first input of the serial adder 37 with a repetition frequency of $f$ = shift pulse rate number/number of shift register cells, namely with its least important bit, called LSB (least significant bit) in the following. Concurrent with this time point, a word contained in the first auxiliary storage register 19 can then also appear at the second input of the serial adder 37, whenever the AND gate 41 is opened. The sum of the words A and B, which are stored, respectively, in the shift register 38 and in the auxiliary storage register 19, then appears as the serial counting result at the summing output of the serial adder 37 at the rate of the shift pulse frequency. The serial counting result is also present in a parallel form in the shift register 38 at the time at which the LSB of the word in the shift register 38 appears at the first input of the serial adder 37, and it can also be retrieved, though only at this time, in its parallel configuration. For this purpose a reference rate pulse is required, which appears during the LSB timepoint at the first input of the serial adder 37, or at the MSB (most significant bit) timepoint at the summing output of the serial adder 37, and which reference rate pulse can be extracted from the system. This reference rate pulse is also required particularly when, during the repeating addition (the content of the shift register, after all, recirculates continually at the shift pulse frequency), the capacity of the numerical frequency converter 20 is exceeded. In the event that a CARRY appears at the MSB timepoint at the summing output of the serial adder 37, the CARRY obtained for a full shift register component must be extracted or diverted by the reference rate pulse, in order that no erroneous addition of the CARRY to the LSB shall result. It is to be noted that the register capacity is only 2 to the eighth power, due to the dual multiplex operation, even through 16 shift register cells are provided. Thus a CARRY also takes place for a full 8 bit shift register component, whenever the capacity 2 to the eighth power is reached or exceeded. For the case where the capacity is exceeded at both register components (this is only possible in the multiplex raster, that is to say, chronologically sequentially,) two overrun pulses are then also generated, which are mutually offset by eight shift pulses. The required reference pulse thus repeats periodically after each eighth shift pulse. The extracted CARRY at the serial adder 37, or the sum of the CARRYs during a definite time interval, can be viewed as a signal frequency, which results from the information respectively stored in the shift register 38 and in the first auxiliary storage register 19. The relative distribution of these CARRY signals during the given time span is of subordinate significance. The CARRY pulses which appear at the output of the serial adder 37, respectively at the output of the AND gate 43 which serves for the referencing of the CARRY pulses at a reference pulse rate, are dependent, as already indicated, upon the storage register contents of the first auxiliary storage register 19. In addition, the register capacity of the shift register 38 and the initial value in the shift register 38 also exert an influence. The output of the AND gate 43 connects to a bistable flip flop stage 44 or a delay stage, which serves to create a running time equalization relative to the serial adder, and concurrently serves to synchronize the CARRY pulses with a given specified pulse rate.

Since, according to FIG. 3, the numerical frequency converter 20 shall also accomplish a sign digit control for the counting pulses appearing at the output of the bistable flip flop stage 44, a sign digit control, which encompasses the EXCLUSIVE OR gates 39, 40, 45 is provided. However, the sign digit control is only active when the circuit is operated as an air number (λ) regulating apparatus.

The formation of the counting pulses takes place in the following manner: The word stored in the first auxiliary storage register 19 is continuously added at the shift rate to the initial register value of the shift register 38. The content of the shift register 38 increases linearly, wherein the slope depends upon the word in the first auxiliary storage register 19. When the sum is larger than the maximal word length possible, an unequivocal 1/0 transition of the MSB results, as was already further explained above. This transistion is used as a counting pulse, and is conducted on to the serial counter 24 according to FIG. 2, via the bistable flip flop stage 44. The shift register 38 is concurrently reset to the initial value. If a word is continuously subtracted from this initial value at the frequency of the shift pulse, the content of the shift register 38 decreases continuously. When the difference is less than zero, an unequivocal 0/1 transition results, which is evaluated as a counting pulse and which resets the shift register 38 to the initial value. This cited initial value is not constant, but rather depends upon the overrun remainder. Herein the EXCLUSIVE OR circuit 45 forms the sum from 128 + overrun remainder during a positive overrun (1/0 transition). This value is then the new initial value. During a negative overrun (0/1 transition), the difference of 128 − overrun remainder is used as the new initial value.

As already further indicated above, the AND gate 41 is respectively switched open and closed by a synchronizing apparatus 42. The word stored in the first auxiliary storage register 19 is thereby multiplicatively combined with the release frequency delivered by the synchronizing apparatus 42, by means of the subsequent processing in the serial adder 37. However, it is to be noted that the release frequency of the synchronizing apparatus must be at least as long as one shift length of an 8 bit shift cycle, since otherwise falsification of data appears during the combining process.

The synchronizing apparatus 42 has the task of bringing various input signals, which are conducted to this synchronizing apparatus, into a multiplex pattern, that is to say, into the multiplex pulse rate. Therewith the sequence for the computation of the time dependent factors for the starting enrichment and the post starting enrichment, as well as for the short integration time constant in the air number λ regulation and for the long integration time constant in the air number λ regulation is unequivocally defined. Input signals for synchronizing apparatus 42 consist of the conditioned probe voltage of an oxygen trace constituent sensor (not shown) disposed within the exhaust system of the combustion engine, wherein the air number λ probe voltage is conditioned in a limiting apparatus not here shown, and thus delivers a digital switching signal Uλ for the count control of the first numerical frequency converter 20 and for the serial counter 24 interconnected to the output of the numerical frequency converter 20, fixed frequencies which are diverted from a central main divider and which determine the minimal regulation times for the post starting enrichment and the starting enrichment, a signal corresponding to the revolutions per unit time wherein the frequency of the revolutions per unit time determines the minimal possible integration time constant of the air number λ regulation apparatus, and a counting frequency which determines the minimal possible integration time constant of the long term air number λ regulation.

After describing the method of operation of the first numerical frequency converter 20, the method of operation of the serial counter 24 interconnected to the output of the numerical frequency converter 20 and the method of operation of this circuitry in the regulation of the air number λ shall once more be taken up in the following: With every counting pulse of the first numerical frequency converter 20 lying in the multiplex raster of the post starting enrichment, the initial value of the digital information concerning the post starting enrichment is increased by 1, until the register state has reached a given number $Z_{max}$. Therewith the regulation process is completed, that is to say, the post starting enrichment is shut off. The recognition of the state where the regulation equals the maximal number $Z_{max}$ takes place within a level recognition logic circuit 60 according to FIG. 4. When the factor for the post starting regulation is larger than, or equal to, the given number $Z_{max}$, then the level recognition logic circuit 60 delivers at its $Z_{max}$ output an L-signal. This L-signal preemptorily switches the counting direction of the serial counter 24 to the BACKWARD counting mode via the UP/DOWN control. Herewith the register value oscillates in the regulated condition about the values $Z_{max}$ and $Z_{max} - 1$. It is advantageous in this apparatus, that during a disturbance of the post starting regulation, wherein the regulation factor is greater than $Z_{max}$, after a certain regulation interval the value $Z_{max} - 1$ once again stands in the shift register. This fact yields an automatic error correction. The regulation of the air number λ is hence only operative when a signal S, which turns the regulation of the air number on, is available, and the post starting enrichment and the starting enrichment have been regulated. Furthermore, the value in the second auxiliary storage register 25 of the serial counter 24, namely the value $Z_{max}$ or the value $Z_{max} - 1$, serves as the initial value for the regulation of the air number λ. During the operation of this λ regulation apparatus, a maximal register state must not be exceeded additively, and a minimal register state must not be exceeded subtractively. This level limiting of the λ regulation region likewise takes place by means of the level recognition logic circuit 60. The switching of the regional limits for the λ regulation is likewise effected by the signal Sλ.

When the serial counter 24 is operated as a regulation apparatus with a small integration time constant, then the regulation apparatus is directly controlled by an oxygen measuring probe disposed in the exhaust current of the combustion engine, wherein the counting frequency determining the integration time and the sign digit control is, as already further elucidated above, delivered by the first numerical frequency converter 20. An integration of the small time constants for the λ regulation is herein achievable by means of the integration time determining information of the addition frequency of the first numerical frequency converter 20, wherein a proportionality relation to the revolutions per unit time is taken into account. The regulation stroke for the λ regulation operation can be freely chosen. The regional limits are therein formed by means of $Z_{max\ 1}$ and $Z_{min\ 1}$.

When the serial counter 24 is operated as a regulation apparatus having a long integration time constant, then the regulation stroke is limited by the regional limits $Z_{max\ 2}$ and $Z_{min\ 2}$. The switching of the regional limits $Z_{min\ 1}$ and $Z_{max\ 1}$, as well as of $Z_{min\ 2}$ and $Z_{max\ 2}$, takes place in the level recognition logic circuit 60, by means of the time multiplex pulse $\phi 2$, or the complementary $\phi 2$. The λ regulation having a long time constant is normally not operative whenever the working region of the λ regulation having the short integration time constant lies within the regional limits.

Not until the λ regulator having the short integration time constant arrives in the limiting region is the basic integrated varied by means of the λ regulation having the long time constant, therewith accommodating the λ regulator having the short integration time constant in such a manner that it operates approximately in the middle of the regulation region. The overrun signals from the level recognition logic circuit 60, which originate during the multiplex duration for the λ regulation having the short integration time constant, are correlated in the OR gate 56, and are stored in the synchronizing logic 42 in the multiplex raster for the long integration time constant, and serve as counting pulses and sign digit pulses for the λ regulation having the long integration time constant. The time constant of the regulation having the long integration time constant is, therefore, dependent upon the frequency of the overruns. The time constant can additionally be made variable, by virtue of the combinatory linkage of the overrun frequency with the programmable number during the long integration time constant in the first numerical frequency converter 20.

Figure 4:
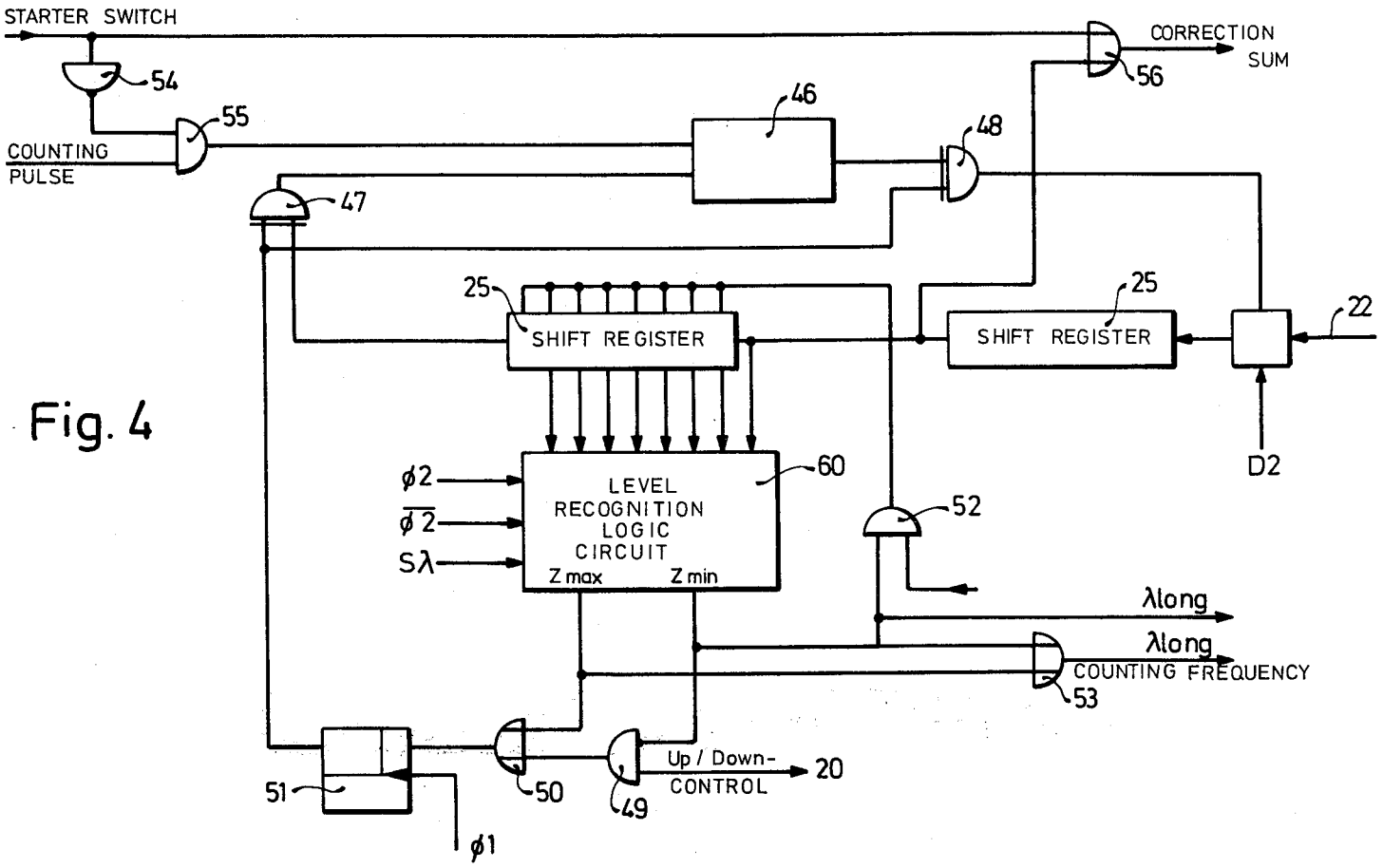
FIG. 4 is a detailed block circuit diagram of a serial counter of FIG. 2.

FIG. 4 depicts a detailed block circuit diagram of the serial counter 24. The serial counter 24 possesses, as does the first numerical frequency converter 20, a serial adder 46 with the second auxiliary storage register 25 interconnected thereto in parallel. The method of operation of the serial adder 46 and the second auxiliary storage register interconnected in parallel corresponds in principle to the method of operation of the serial adder 37 and its parallel shift register 38 of the first numerical frequency converter 20, and is, therefore, not again described in detail. Beyond the foregoing, according to FIG. 4, the serial counter 24 additionally features a FORWARD-BACKWARD counter control having an EXCLUSIVE OR gate 47 and an EXCLUSIVE OR gate 48. The method of operation of the level recognition logic circuit 60 has already been illustrated. Additionally, an AND gate 49, an OR gate 50, and a bistable flip flop stage 51 are provided for the sign digit control. The function of the sign digit control is to cause the serial counter 24 to count FORWARD via the FORWARD-BACKWARD counter control 47, 48 whenever a LOGIC 1 appears on the line $Z_{min}$ of the level recognition logic circuit 60, and to cause the serial counter 24 to count BACKWARD whenever a LOGIC 1 appears on the ling $Z_{max}$. Finally a SET logic having an AND gate 52 is additionally provided, with the aid of which an initial word number for the loading of the second auxiliary storage register 25 can be inserted during an excessively strong drop of the output value for the λ regulation in the case of a disturbance of the content of the register 25. Finally provided is a logic function using an OR gate 53 for the acquisition of the counting pulses for the λ regulation having a long integration time constant.

In addition, the serial counter 24 is provided with an inverter stage 54, and AND gate 55, and an OR gate 56 for the blocking of the serial counter 24 during the starting phase of the combustion engine, since during this phase no interaction by the serial counter 24 is required, since none is desired.

The illustrated correction apparatus collectively possesses the following advantages: By means of a similar circuit structure and of the possibility of utilizing dynamic shift registers, the concept is well suited for a large scale integration. Finally possibilities exist for interaction with additional correction factors, which can be combinatorily linked in a multiplicative mode with the cited existing factors, for which added use no particular additional effort is required.

The just described correction computer 15, according to the invention, can also be utilized with particular advantage for altitude correction in a fuel injection apparatus for combustion engines, and in particular when the correction computer 15 also encompasses an air number λ regulation, that is to say, when a so-called oxygen probe is disposed within the exhaust system, which oxygen probe, as already mentioned herein previously, participates jointly in the determination of the duration of the fuel injection pulses to be conducted to the combustion engine. In this case, the composition of the exhaust gases can be regulated to possess a minimal content of noxious substances even at high altitudes by means of an expansion of the λ regulation region.

It is fundamentally appropriate, that during the operation of a motor vehicle, powered by a combustion engine, at altitudes above approximately 1000 meters, the possibility of an altitude dependent correction of the injection time computed by the fuel injection apparatus be anticipated, since due to the altered specific weight of the air, the $O_2$ constituent for the computed injection quantity will otherwise be too small. If a separate transducer is here utilized, then the injection time ought to be decreased respectively by 5% per 1000 meters of altitude, or, therefore, by 15% at 3000 meters. This additional correction can be then undertaken by an asymmetrically expanded λ regulation region, when one takes into consideration that during the "cold phase" of the λ regulation the mixture becomes too rich, and is only made leaner when the λ probe temperature is reached. For that reason an additional lean-making region of approximately 15% must be provided, wherein the mixture is then kept constant independent of the given altitude by means of the λ probe or oxygen probe. A given time constant provided for this purpose is substantially greater than the regulation time constant, that is to say, onto the normal λ time constant for, for example, a +/− 5% stroke, there is superimposed in the regulation a substantially greater time constant for the long term variation, for example for the altitude operation. Thus the effect is obtained wherein the basic integration is varied by very large time constants, whose order of magnitude can, for example, comprise minutes, by means of the λ probe, and wherein the intrinsic λ-correction having a normal, short time constant is superimposed thereon.

What is claimed is:

1. A fuel injection apparatus for internal combustion engines, having fuel injection valves and control means for generating fuel injection control pulses to control said fuel injection valves, said control means including:

a main computer and means for supplying to said main computer data relating to the prevailing engine speed and air flow rate for the purpose of changing the duration of said fuel injection pulses;

a central memory containing digitally coded information related to each operational engine variable;

a correction computer for receiving the digital information from said central memory and for generating therefrom a correction frequency to be applied to said main computer for the adjustment of said fuel injection control pulses, said correction computer including at least two auxiliary memories (19, 25, 30, 34) for receiving the digital data in said central memory depending on the external engine variables and in multiplex sequence, each of said auxiliary memories being associated with a numerical frequency converter, and at least one pair of auxiliary memory and associated numerical frequency converter constituting a first corrective sub-system which receives a constant counting frequency from which the correcting sub-system generates a correction frequency in consideration of the information stored in the auxiliary memory and said apparatus including at least one other correcting sub-system consisting of an auxiliary memory and an associated numerical frequency converter, said other correcting sub-system receiving the output correction frequency of said first correcting sub-system for performing a renewed alteration of said frequency in dependence on the digital information being stored in the auxiliary memory; whereby at least two correcting sub-systems in said correcting computer are connected in functional series.

2. The fuel injection apparatus according to claim 1, wherein said numerical frequency converter means includes a first numerical frequency converter operated in a multiplex mode, to which a constant counting frequency is supplied, and which forms a counting frequency in accordance with the storage register content of an associated first auxiliary storage register of said auxiliary storage register means, which counting frequency is variable by means of the information stored in said first auxiliary storage register concerning a starting enrichment and a post starting enrichment of the fuel-air mixture delivered to the internal combustion engine.

3. The fuel injection apparatus according to claim 2, further having a serial counter means for the chronological regulation of the starting enrichment and the post starting enrichment of the fuel-air mixture, said serial counter means having a first input connected to receive the counting frequency output of the first numerical frequency converter, and a second input connected to a second auxiliary storage counter of said auxiliary storage counter means, in which information for a temperature dependent initial value is storable, wherein the output signal of the serial counter means is a number that is time dependently variable by means of the frequency of the first numerical frequency converter.

4. The fuel injection apparatus according to claim 3, wherein said serial counter means, which possesses the characteristics of an integrator and which can count in a FORWARD and a BACKWARD counting direction, and said first numerical frequency converter are connected to be used as an integrating regulator for the regulation of the air number λ of the fuel-air mixture in accordance with the composition of the engine exhaust gases.

5. The fuel injection apparatus according to claim 4, in which data concerning the air number λ regulation are storable in the second auxiliary storage register assigned to the serial counter means, and in the first auxiliary storage register assigned to the first numerical frequency converter, and various integration time constants of the integrating regulator for the air number λ regulation are obtainable through the utilization of the multiplex operation, wherein a first long integration time constant is used for the regulation of the long term drift and a second short integration time constant is used for the regulation of momentary variations of the air number λ.

6. The fuel injection apparatus according to claim 4, wherein the first numerical frequency converter, in its employment for the regulation of the air number λ, includes a sign digit control apparatus for the correct sign digit evaluation of the counting pulses supplied by the first numerical frequency converter to the serial counter means.

7. The fuel injection apparatus according to claim 4, wherein the serial counter means includes a logic circuit means for the recognition and the limiting of the regulation region of the air number λ.

8. The fuel injection apparatus according to claim 3, wherein the serial counter means is connected to a second numerical frequency converter of said numerical frequency converter means, to which an input frequency is supplied, and which links the output signal of the serial counter means is a multiplicative combination with the input frequency.

9. The fuel injection apparatus according to claim 8, wherein the second numerical frequency converter links the correction magnitudes supplied by the serial counter means to each other in an additive combination, prior to the multiplicative combinatory linkage with the input frequency.

10. The fuel injection apparatus according to claim 8, in which the input frequency of the second numerical frequency converter is generated by a fourth numerical frequency converter of said numerical frequency converter means to which a particular, constant input frequency is supplied, and to which a fourth auxiliary storage register of said auxiliary storage register means is assigned, in which, in particular, data concerning an idle running apportionment, a partial load apportionment, and a full load apportionment, are storable, wherein the output signal of the fourth numerical frequency converter possesses a frequency which is a function of the just stored data.

11. The fuel injection apparatus according to claim 10, wherein the input frequency is variable under consideration of further correction values, respectively operational parameters of the combustion engine, in accordance with these given values.

12. The fuel injection apparatus according to claim 8, in which the second numerical frequency converter is dynamically interconnected to a third numerical frequency converter of said numerical frequency converter means, wherein the output frequency of the second numerical frequency converter constitutes the input frequency for the third numerical frequency converter, and a third auxiliary storage register of said auxiliary storage register means is connected to the third numerical frequency converter in which third auxiliary storage register data concerning a starting enrichment and a warm running enrichment of the fuel-air mixture supplied to the combustion engine are storable, wherein the third numerical frequency converter generates an output signal which constitutes a multiplicative combinatory linkage of the input signal with the information just stored in the third auxiliary storage register, which third numerical frequency converter output signal comprises the correction signal at the correction frequency, which correction signal is conducted to the control means serving for the formation of the uncorrected injection pulse.

13. The fuel injection apparatus according to claim 1, further having gating circuit means, addressing logic circuitry, and a central data bus line, wherein the gating circuit means are respectively interconnected upstream of the auxiliary storage register means, which gating circuit means are controllable in a multiplex operation via the addressing logic circuitry, and which respectively connect the auxiliary storage register means via the central data bus line with the main storage register in accordance with that given controlling function.

14. The fuel injection apparatus according to claim 2, wherein the first numerical frequency converter features a serial adder to whose inputs two words are delivered for a serial addition, and to which serial adder a shift register is connected in parallel, whose output is connected to the one input of the serial adder via an EXCLUSIVE OR gate, wherein the output of the serial adder is connected to the input of the shift register via a further EXCLUSIVE OR gate, and wherein an O-signal or an L-signal can be conducted to the given second input of the EXCLUSIVE OR gate according to the given desired counting direction.

15. The fuel injection apparatus according to claim 14, wherein the input of the serial adder of the first numerical frequency converter that is not connected to the shift register is directly preceded by an AND gate to which the given serial binary numbers stored in the first auxiliary storage register, and a gating signal controlling the addition process, are conducted for the serial numerical frequency conversion, and wherein the gating signal remains unchanged at least over the time span of an 8 bit shift cycle of the shift register.

16. The fuel injection apparatus according to claim 14, wherein the serial adder features a transition output, at which an overrun pulse is extractable whenever the register capacity of $2^8$ is reached, which overrun pulse becomes a transition pulse sequence, during the periodic repetition of the addition process, which transition pulse sequence, is a function of the given storage register content of the first auxiliary storage register and of the register capacity and the initial value of the shift register.

17. The fuel injection apparatus according to claim 16, wherein the transition output of the serial adder is connected to a bistable flip flop stage via a gating circuit, which bistable flip flop stage serves for the equalization of the running time of the serial adder and for the synchronization of the transition pulse sequence with respect to a predetermined given pulse rate.

18. The fuel injection apparatus according to claim 15, wherein the gating signal for the AND gate is supplied by a synchronizing apparatus to which various input signals of the synchronizing apparatus are deliverable, in particular an electrical, digital signal characterizing the oxygen trace constituents in the exhaust gases of the engine, digital sign digit signals for the λ regulation, fixed frequency signals for the minimal regulation time of the post starting enrichment and the starting enrichment, minimal integration time constants for the λ regulation apparatus, and signals designating the revolutions per unit time incorparable into a multiplex raster.

19. The fuel injection apparatus according to claim 7, wherein the logic circuit means, in establishing the limits of the regulation region in the regulation of the air number λ, diminishes the counter state by preferably one count, as the maximal counter state limiting the regulation region is reached, and increases the counter state by preferably one count as the minimal counter state limiting the regulation region is reached.

20. The fuel injection apparatus according to claim 19, further having a recognition logic circuit, wherein the serial counter means can be preemptorily set to the minimal counter state during operation as a regulation apparatus for the air number regulation, when the minimal counter state is subtractively exceeded in the event of a disturbance, by means of the recognition logic circuit.

21. The fuel injection apparatus according to claim 1, wherein the regulation region of a λ regulation is assymmetrically expanded by approximately 15% in the direction of a lean state, for an altitude correction.

22. A fuel injection apparatus according to claim 1, wherein all auxiliary memories (19, 25, 30, 34) of said correcting sub-systems are connected in parallel with the output line (22) of said central memory (14) and wherein each of said auxiliary memory of each of said correcting sub-systems has associated with it switching logic (21, 32, 36, 26) being controlled in multiplex operation.

* * * * *